US005388409A

United States Patent [19]

Meijer

[11] Patent Number: 5,388,409

[45] Date of Patent: Feb. 14, 1995

[54] STIRLING ENGINE WITH INTEGRATED GAS COMBUSTOR

[75] Inventor: Roelf J. Meijer, Ann Arbor, Mich.

[73] Assignee: Stirling Thermal Motors, Inc., Ann Arbor, Mich.

[21] Appl. No.: 61,902

[22] Filed: May 14, 1993

[51] Int. Cl.[6] ..... F02G 1/04

[52] U.S. Cl. ..... 60/525; 431/353

[58] Field of Search ..... 60/524, 525, 517; 431/353, 354

[56] References Cited

U.S. PATENT DOCUMENTS

| | | | |
|---|---|---|---|
| 2,850,875 | 9/1958 | Burner . | |
| 3,492,813 | 2/1970 | Meijer . | |
| 3,845,626 | 11/1974 | Berntell et al. . | |
| 4,639,212 | 1/1987 | Watanabe et al. . | |
| 4,665,700 | 5/1987 | Bratt | 60/525 |
| 4,768,342 | 9/1988 | Darooka | 60/525 |
| 4,805,588 | 4/1978 | Reams et al. . | |
| 4,977,742 | 12/1990 | Meijer . | |
| 5,118,283 | 6/1992 | Sattelmayer | 431/9 |
| 5,220,888 | 6/1993 | Khinkis et al. | 431/173 |

FOREIGN PATENT DOCUMENTS

| | | | |
|---|---|---|---|
| 2156441 | 10/1985 | United Kingdom | 60/525 |
| 2194596 | 3/1988 | United Kingdom | 60/517 |

*Primary Examiner*—Edward K. Look
*Assistant Examiner*—Mark Sgantzos
*Attorney, Agent, or Firm*—Harness, Dickey & Pierce

[57] ABSTRACT

A Stirling engine having a cooler, regenerator and heat exchanger stacked end to end along with a working cylinder position adjacent to the heat transfer stack and connected thereto by several connecting ducts. By using more than one hot connecting duct, their bending stiffness is less as compared with a single duct being the same area as the multiple ducts, allowing thermally induced relative displacement between the elements to occur. The heat exchanger includes a plurality of axially extending tubes spaced apart from one another with a combustor positioned adjacent to the tubes such that the combustion gases flow between the tubes. The tubes are preferably flattened in the direction of the gas flow between them to increase the surface area for heat transfer. Furthermore, wire is coiled around and brazed to the tubes creating a fin for additional heat transfer. A gas flow restrictor is positioned around the heat exchanger tubes over a portion of their lengths in order to produce isothermal heating of the tubes. The combustor has a number of tangential air flow inlets which mixes air with a combustible fuel injected from a nozzle providing a highly turbulent combustion gas flow.

19 Claims, 5 Drawing Sheets

STIRLING ENGINE WITH INTEGRATED GAS COMBUSTOR

BACKGROUND AND SUMMARY OF THE INVENTION

This invention relates to a multiple cylinder Stirling engine and particularly to one that has multiple gas combustors which act as heat sources for the engine which are integrated into the structure of the engine.

Stirling cycle engines may be powered directly by a source of heat such as from solar energy sources, combusted gas, etc. The output mechanical energy of the engine can be used to do direct work or for the generation of electrical energy, etc. In some applications, it is desirable to use flue gases from a combustible fuel to provide the heat input energy for the engine. In one type of prior art Stirling engine, a combustion apparatus remote from the engine is used in which the heat energy is transferred through a heat transport mechanism such as a liquid metal heat pipe. Although such devices perform very satisfactorily and do offer thermodynamic benefits, they constitute, however, a large proportion of the heat capacity of the heating system which requires a considerable warm-up time. For some applications, this is not desirable. Moreover, the requirement of providing a heat pipe adds to the complexity and packaging size of the total system.

Other types of prior art Stirling engines incorporate one large gas combustor in combination with an integrated heater head of a number of working cylinders. Such heater heads are not very suitable for volume production due to the complexity and long brazing time of the tubes in the massive heater heads. Other prior art Stirling engines with integrated combustors have efficiency disadvantages due to the configuration of combustor and the heat transfer surfaces of the engine heat exchanger.

This invention is directed toward a Stirling engine with multiple gas combustors that are integrated into the structure of the engine to provide a compact and efficient energy conversion machine. The system eliminates the requirement of a separate heat pipe for transferring heat from a remote source. Individual combustion chambers are provided for each of the cylinders of a multiple cylinder Stirling engine. The relatively small size of the combustion chamber allows the heat exchanger for each cylinder to be constructed of a circular bundle of tubes terminating in a circular manifold. The manifold is connected to the cylinder by one or more hot connecting ducts.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
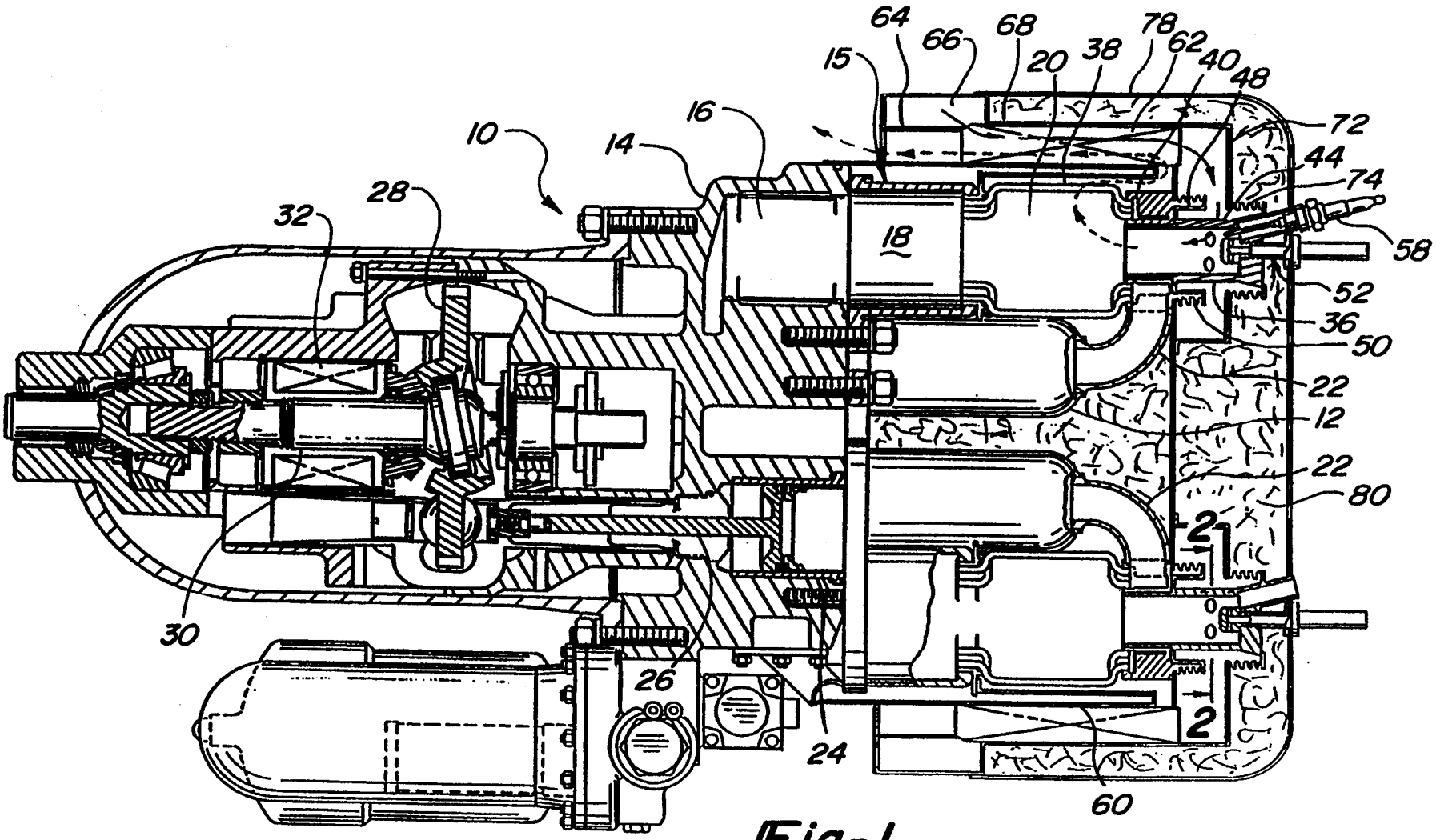
FIG. 1 is a longitudinal partially cross-sectional and partially elevational view of a Stirling engine with integrated gas combustors in accordance with this invention.

A Stirling engine in accordance with this invention is shown in FIG. 1 and is generally designated by reference number 10. As shown, engine 10 includes four substantially parallel piston cylinders 12 which are disposed in a square cluster about a central axis within drive mechanism housing 14. This invention may, however, be used with engines having various numbers of cylinders. Associated with each piston cylinder 12 and located on an end surface of drive mechanism housing 14 are heat transfer stacks 15 comprising cooler 16, regenerator 18, and heat exchanger 20. Cooler 16, regenerator 18 and heat exchanger 20 are arranged end-to-end to form a cylindrical column which communicates with piston cylinder 12 via connecting duct 22.

Located within each piston cylinder 12 is a movable piston 24 and a connecting rod 26. Swashplate 28 converts the reciprocating axial motion of pistons 24 to rotary motion of output shaft 30. The angle of swashplate 28 can be changed by rotating the swashplate relative to output shaft 30 to vary the output of the engine. This rotation is effected by a stroke converter 32. Additional details of the operation of Stirling engine 10 can be obtained by reference to issued U.S. Pat. No. 4,481,771 which is hereby incorporated by reference and is assigned to the assignee of this invention.

Heat is inputted to Stirling engine 10 through separate combustor assemblies 36 associated with each of heat exchangers 20. As shown, heat exchangers 20 are comprised of a plurality of relatively thin and flexible tubes 38 through which the working cycle fluid (e.g., helium) of Stirling engine 10 flows. The working fluid flowing through tubes 38 collects at annular manifold 40 which communicates with connecting duct 22.

Figure 2:
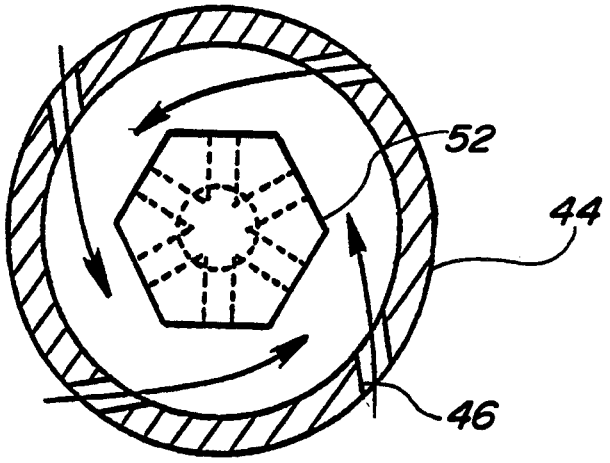
FIG. 2 is a cross-sectional view taken along line 2—2 of FIG. 1 showing the air inlet passages of the combustor and the gas nozzle.

Each combustor assembly 36 includes combustion chamber tube 44 which has a plurality of generally tangential air inlets 46, best shown with reference to FIG. 2. Air inlets 46 are shaped to generate a swirling tangential flow of air entering cylinder 44 as shown by the arrows in FIG. 2. Flange 48 surrounds tube 44 near its longitudinal midpoint and forms a surface for attachment of bellows 50 which provides a gas seal, but permits relative movement of the components as they are exposed to thermal gradients and expansion.

Figure 3:
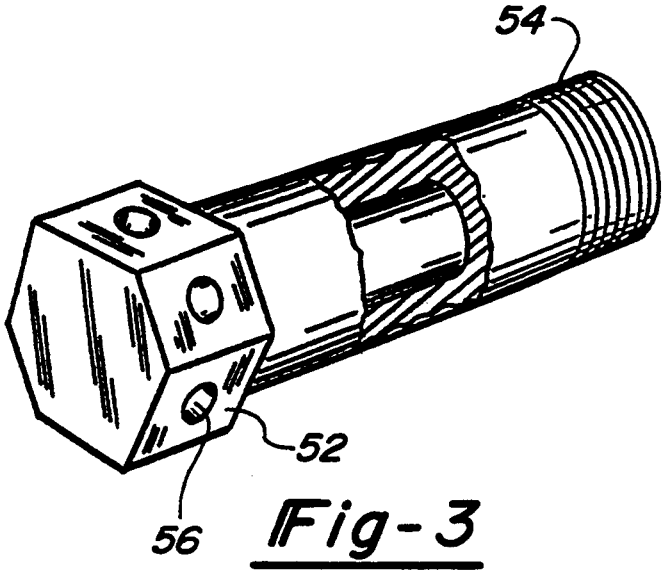
FIG. 3 is a pictorial view of the gas nozzle used with the combustors according to this invention.

A combustible gas is introduced into combustion chamber tube 44 through gas nozzle 52. As best shown in FIG. 3, gas nozzle 52 includes a central gas passage 54 and a plurality of radially directed gas outlet passages 56. The combination of the swirling flow of air introduced into chamber cylinder 44 through inlets 46 and the radial flow of gas out of gas nozzles outlet passages 56 serves to provide a highly turbulent combustible gas flow within the chamber which provides for efficient and clean combustion. Ignition plug 58 is provided to initiate combustion.

Heat exchanger wall 60 surrounds engine 10 and serves to confine hot gases from combustion chamber tubes 44 within heat exchangers 20. Radially outside of wall 60 are counterflow heat exchangers 62. As shown by the phantom line arrows, exhaust gases are permitted to flow through heat exchangers 62 and escape between walls 60 and 64. Inlet air also passes through heat exchanger 62 from air inlet 66 formed between annular walls 64 and 68 as shown by full line arrows in FIG. 1. Inlet air is accordingly heated through heat exchange with the exhaust gases to provide enhanced thermal efficiency of engine 10. Wall 68 also forms a radially inward flange 72 which communicates with the closed end of combustion tubes 44 by bellows 74 which also provides a gas seal while permitting movement of the relative components in response to temperature changes. The region between wall 68 and outer housing 78 is packed with a thermal insulating material 80.

Due to the relatively small size of combustion chamber tubes 44, heating of those elements does not cause significant thermal expansion. A relatively short warm-up time is provided due to the small mass of the tubes as compared with systems in which a unitary combustion chamber assembly is used for heating an integrated heater head belonging to a number of Stirling engine cylinders. Moreover, the gas flow within tubes 44 produces excellent mixing of air and fuel resulting in high combustion efficiencies and low output emissions.

Figure 4:
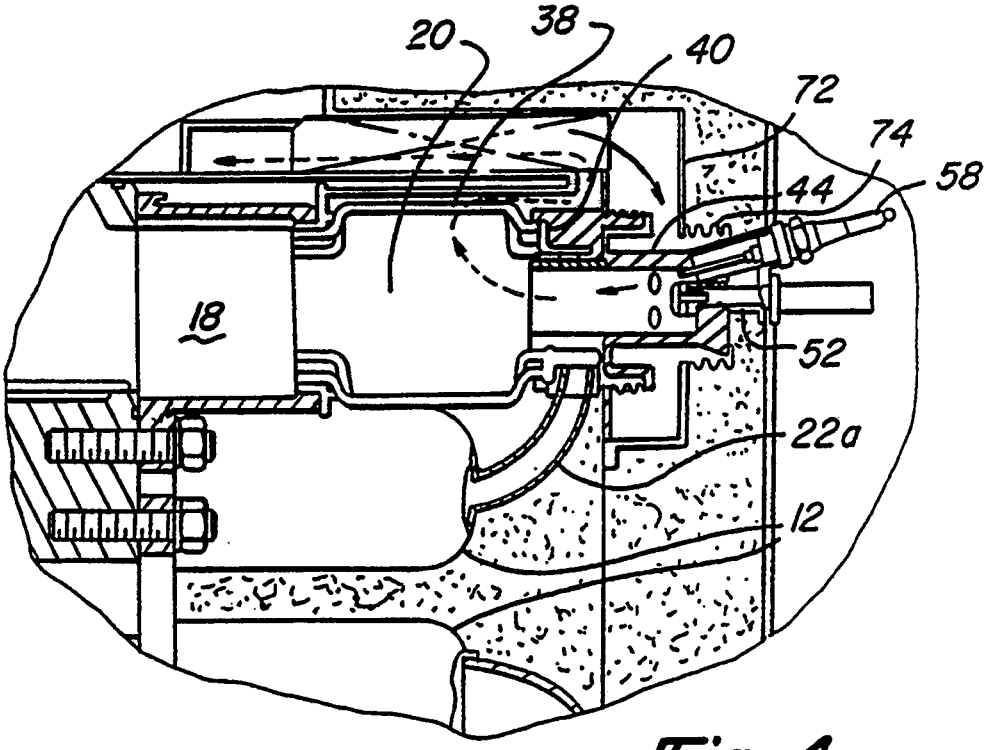
FIG. 4 is a fragmentary partially cross-sectional and partially elevational view of an alternative embodiment of a Stirling engine.
Figure 5:
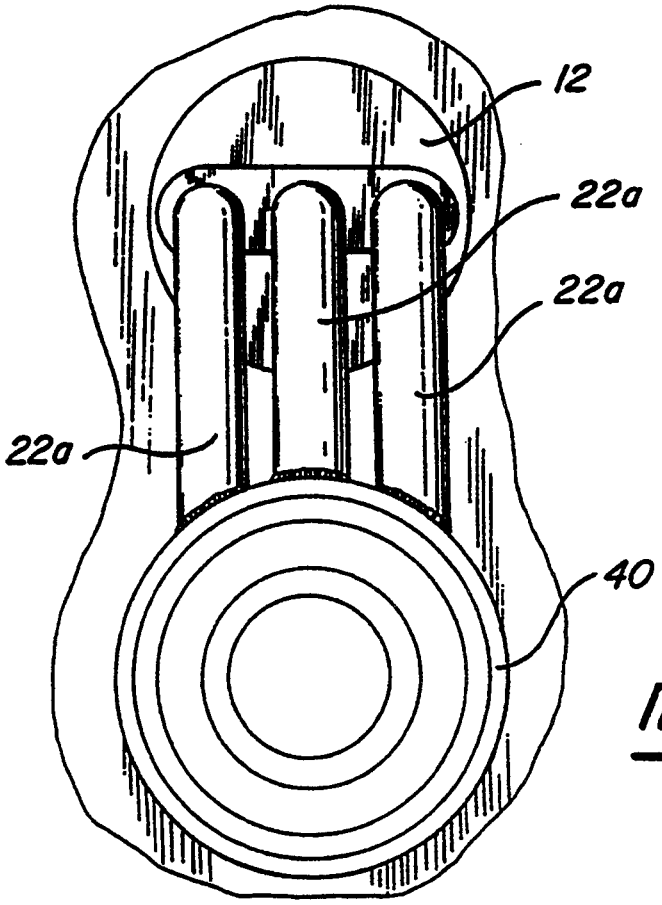
FIG. 5 is a fragmentary end view of the Stirling engine of FIG. 4.

FIGS. 4 and 5 illustrate an alternative embodiment of the Stirling engine shown in FIG. 1. In these figures, like reference numerals are given to like components while components that have been modified are given the same reference numeral with a suffix "a". In this alternative embodiment the single hot conducting duct 22 has been replaced by a plurality of smaller ducts **22*a*. In this illustration, three tubes 22*a* are provided. The ducts 22*a* are inherently more flexible than the single duct described previously to enable movement of the piston cylinders 12 relative to the adjacent heat transfer stack to accommodate thermal gradients and expansion. Bending deflection of the ducts 22*a* permit the relative movement of the stacks and cylinders. The three connecting ducts 22*a* have the same cross sectional area as the single ducts 22 described previously to enable substantially equal flow of the working gas between the stacks and cylinders. The use of a plurality of smaller ducts 22*a*** of lower stiffness than a single larger duct reduces stresses and deformation of the heat exchanger, resulting in longer life and better heat transfer and eliminates the use of bellows or other compliant structures for accommodating thermal expansion.

The three ducts **22*a* are joined to the annular manifold at the same location relative to the longitudinal axis of the heat transfer stacks. This arrangement of the ducts 22*a*** provides the minimum bending stiffness for the combination of ducts. If the ducts were arranged to lie in a common plane with the ducts joined to the manifold at axially spaced locations, the bending stiffness would be increased, inhibiting bending deflection.

Figure 6:
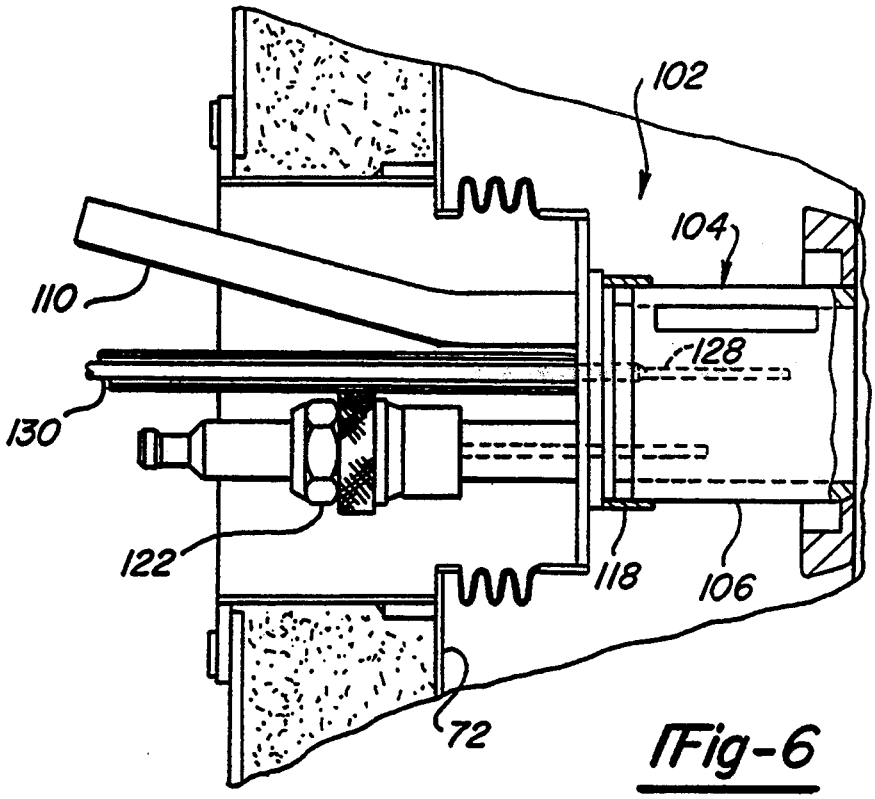
FIG. 6 is a fragmentary partially cross-sectional and partially elevational view of an alternative embodiment of the combustor assembly.
Figure 7:
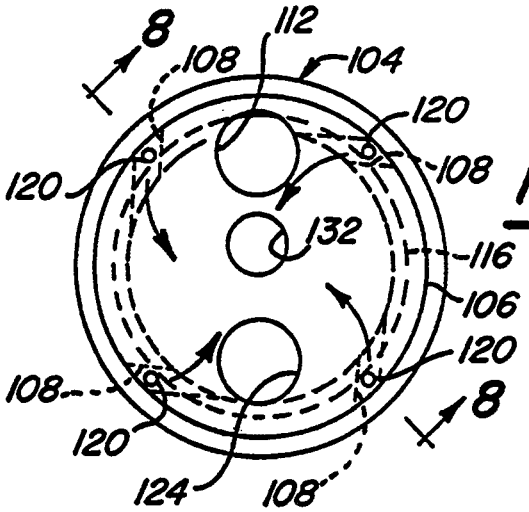
FIG. 7 is an end view of the alternative combustor shown in FIG. 6.
Figure 8:
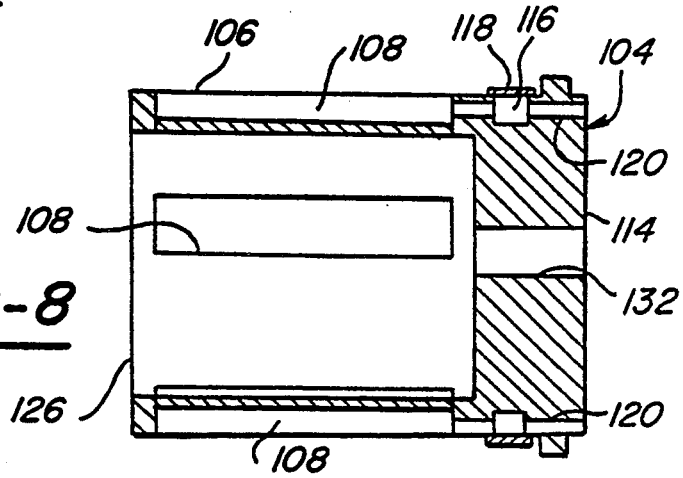
FIG. 8 is a cross sectional view taken along line 8—8 of FIG. 7 showing the air inlet and fuel passages of the combustor.

An alternative embodiment of the combustor assembly is shown in FIGS. 6 through 8 and designated generally at 102. Combustor assembly 102 includes a combustor 104 that is generally tubular in shape. The cylindrical wall 106 of combustor 104 includes four tangential inlet air slots 108. Inlet air slots 108 are positioned tangentially to generate a swirling tangential flow of air entering the combustor 104 as shown by the arrows in FIG. 7.

A combustible fuel is introduced into the combustor by a tube 110. Tube 110 provides fuel to the aperture 112 in the closed end 114 of the combustor 104. The aperture 112 is in communication with a annular groove 116 machined around the periphery of the combustor 104. The groove is sealed with a band 118 surrounding the cylindrical wall enclosing the groove to form an annular chamber. Above each inlet air slot 108, a small passage 120 is machined through the closed end of the combustor, intersecting the groove 116 and extending to the inlet air slots 108. The passages 120 provide communication between the air inlets 108 and groove 116. The end of passages 120 at the closed end 114 of the combustor is sealed when the combustor is assembled. Fuel from supply tube 110 flows into the groove 116, through passages 120 into the inlet air slots 108 where the combustible fuel mixes with the air flowing into the interior of the combustors 104. The velocity of air flowing through the inlets 108 creates a low pressure zone in the inlets drawing the fuel into the inlets where it is mixed with the incoming air. This improves the mixing of fuel with air as compared to combustor assemblies 44 having the gas nozzle inside the combustor tube where the fluid pressure is greater.

Ignition plug 122 extends through aperture 124 in the closed end of the combustor into its interior where it ignites the fuel and air mixture producing a flame within the combustor tube. The hot combustion gases flow through the open end 126 into the center of the heater exchanger 20 of the Stirling engine. A tungsten flame sensor 128 mounted in a ceramic insulator 130 extends through the central aperture 132 in the closed end of the combustor to enable monitoring of the fuel combustion.

Figure 9:
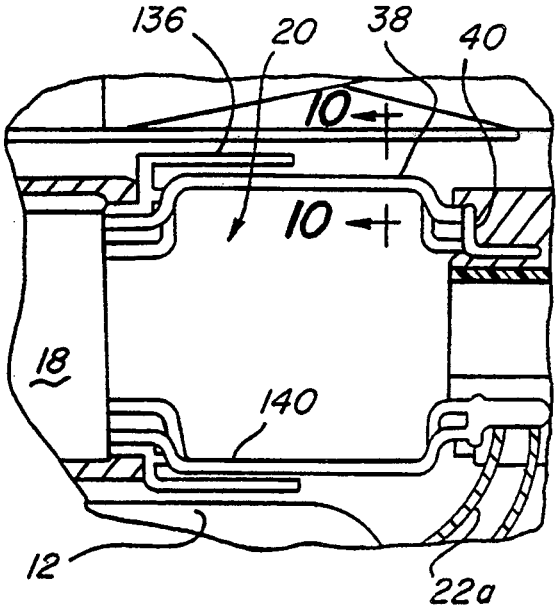
FIG. 9 is a fragmentary partially cross-sectional and partially elevational view of a heat exchanger and a combustor assembly.

FIG. 9 illustrates an improved embodiment of the heat exchanger 20. In a Stirling engine it is desirable for the heat exchanger to be isothermal along the length of the tubes 38. This improves heat transfer to the engine working fluid in the tubes. It has been observed, however, that the portion of the tubes 38 closest to regenerator 18 tends to absorb more heat than the portion of the tubes adjacent the annular manifold 40. This is caused by an uneven flow of combustion gases between the tubes 38 along their axial lengths. By adjusting the gas flow between the tubes, the temperature of the tubes 38 can be equalized along their length. One way to equalize the gas flow between tubes along their length is the addition of a gas deflection shield 136 surrounding the heat exchanger tubes adjacent the regenerator 18. This shield restricts the velocity of combustion gases passing between the tubes adjacent the regenerator compared to the gas velocity flowing between the tubes adjacent the annular duct 40. The result is an increase in the flow rate of escaping hot flow gasses adjacent the duct 40 while lowering the flow rate in the area of the tubes surrounded by the shield, adjacent the regenerator 18, producing a more isothermal heat exchanger.

Figure 10:
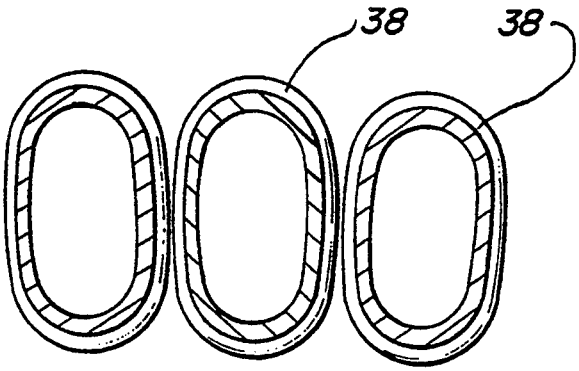
FIG. 10 is a cross sectional view taken along line 10—10 of FIG. 9 showing the heat exchanger tubes.
Figure 11:
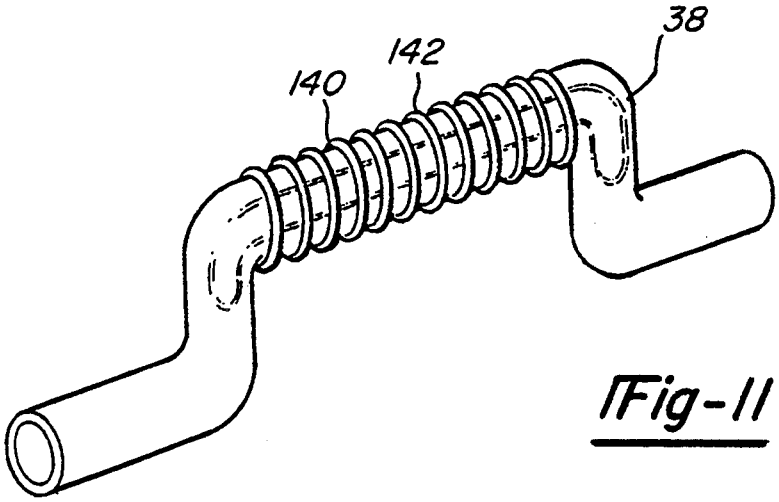
FIG. 11 is a perspective view of a tube used to form the heat exchanger.

The heat exchanger tubes 38 are shown in greater detail in FIGS. 10 and 11. The central portion 140 of the tubes 38 is wrapped with a spring wire 142. After wrapping with the wire, the center portion 140 is slightly flattened to produce the generally oval shape shown in cross-section in FIG. 10. The major axis of the oval shape is parallel to the radial direction of gas flow between the tubes. The spring wire 142 surrounding the tube acts as fins, increasing the heat transfer area for heat transfer from the combustion gases to the working fluid in tubes 38. The flattening of the tubes increases the surface area which the combustion gases pass when exiting the heat exchanger further increasing the heat transfer. By wrapping wire 142 around heat exchanger tubes 38, the uses of one tube contacting those of another act to control the separation between adjacent tubes.

While the above description constitutes the preferred embodiments of the present invention, it will be appreciated that the invention is susceptible of modification, variation and change without departing from the proper scope and fair meaning of the accompanying claims.

I claim:

1. A Stirling engine comprising:

a plurality of heat transfer stacks having a cooler, regenerator and heat exchanger stacked end-to-end along an axis;

a plurality of working cylinders with one cylinder positioned adjacent each of said heat transfer stacks, each cylinder being generally parallel to and spaced from said adjacent stack;

said heat exchangers each including a plurality of tubes for conducting a working cycle fluid of said Stirling engine, said tubes extending axially from said regenerator and terminating in a manifold axially spaced from said regenerator;

at least one combustion chamber having a gas flow outlet communicating with said heat exchangers;

each stack being connected to said adjacent working cylinder by a plurality of connecting ducts for conducting said working cycle fluid between said heat exchanger and said working cylinder whereby bending deflection of said ducts permits movement of each stack relative to the adjacent cylinder as said stacks and cylinders are exposed to thermal gradients and expansion.

2. The Stirling engine according to claim 1 wherein three of said connecting ducts are used to connect each stack to said adjacent working cylinder.

3. The Stirling engine according to claim 1 wherein said combustion chamber includes:

air inlets allowing air to enter the interior of said chambers, and a nozzle within said combustion chamber for introducing a combustible fuel within said combustion chamber whereby said combustible fuel and air combust in said combustion chamber and generate hot gases which apply heat to said heat exchanger.

4. The Stirling engine of claim 1 wherein said plurality of ducts are connected to the manifold of said heat exchangers and said ducts are joined to said manifold at the same axial location along said axis of said stacks.

5. The Stirling engine of claim 1 wherein a combustion chamber is provided for each of said heat transfer stacks.

6. The Stirling engine of claim 1 wherein said connecting ducts are positioned side-by-side with each having one end connected to said working cylinders and aligned generally parallel to said stack axis, and having a second opposite end connected with said manifold and being stacked such that said second end is aligned generally perpendicular to said stack axis.

7. The Stirling engine of claim 1 wherein said connecting ducts overlay one another when viewed in a direction normal to a plane defined by said stack axis and the centerline of its associated of said working cylinders.

8. A Stirling engine comprising:

a heat exchanger having a plurality of elongated tubes for conducting a cylinder working fluid and spaced from one another and generally extending axially in a common direction, said heat exchanger tubes being arranged to define a hollow interior;

a combustion chamber having a gas flow outlet communicating with one axial end of said heat exchanger whereby combustion gases from said outlet flow through the spaces between said tubes heating said tubes, said combustor outlet in communication with said hollow interior whereby said combustion gases flow generally radially outwardly between said tubes; and means for restricting the gas flow between said tubes along a portion of the length of said tubes whereby the heating of said tubes is substantially isothermal along the length of said tubes, said restricting means includes a generally cylindrical shield surrounding said tubes over a portion of their length for reducing the combustion gas flow between said tubes along said portion.

9. The Stirling engine of claim 8 wherein said shield is positioned at the axial end of said heat exchanger tubes opposite said end communicating with said gas flow outlet.

10. A Stirling engine comprising:

a heat exchanger having a plurality of elongated tubes for conducting a working cycle fluid spaced from one another to define gas flow passages therebetween; and a combustion chamber having a gas flow outlet communicating with said heat exchanger whereby combustion gases from said outlet flow through said gas flow passages and said tubes being a non-circular in cross-section and oriented such that they present a larger surface area generally parallel to the direction of gas flow through said gas flow passages as compared with a tube having a circular cross-section of equal area, said tubes further having a wire coil wrapped around said tubes to form fins for increased heat transfer for gas flowing over said tubes.

11. The Stirling engine of claim 10 wherein said tubes having a generally oval cross-sectional shape with the major axis of said oval being oriented substantially parallel to the direction of said gas flow.

12. The Stirling engine of claim 10 wherein said tubes are arranged to define a hollow interior in communication with said outlet so that said gases flow radially outwardly past said tubes.

13. The Stirling engine of claim 10 wherein a portion of said tubes surface area generally parallel to said direction of gas flow is substantially flat.

14. The Stirling engine of claim 10 wherein said wire is brazed to said tubes.

15. A Stirling engine comprising:

a heat transfer stack having a cooler, regenerator and heat exchanger stacked end-to-end along an axis;

a working cylinder positioned adjacent said heat transfer stack parallel to and spaced from said stacks, said stack being connected to said cylinder by at least one connecting duct for conducting a cycle working fluid;

said heat exchanger including a plurality of elongated tubes spaced from one another and extending substantially axially from said regenerator and terminating in a manifold axially spaced from said regenerator, said manifold being in communication with said connecting duct;

a combustion chamber having a cylindrical wall forming a tube open at one end forming a gas flow outlet communicating with said tubes whereby combustion gases from said outlet flow through the spaces between said tubes, said cylindrical wall having a plurality of tangential slots which define air inlets for allowing air to enter the interior of said tube and means forming a fuel nozzle in each tangential slot so that air flowing through said slots draws fuel from said nozzles into the interior of said tubes whereby said fuel and air combust in said tube and generate hot gases which apply heat to said heat exchanger.

16. The Stirling engine of claim 15 wherein said nozzle means includes a groove in said wall axially spaced from said slots, means for enclosing said groove to form an annular chamber and passages extending axially through said wall from said chamber to each of said slots and means for supplying fuel to said sealed chamber.

17. The Stirling engine of claim 19 wherein said groove is machined in the outer surface of said wall and said means for enclosing comprising a band surrounding said wall and overlying said groove.

18. A heat exchanger tube for use in a thermal engine, comprising:

a plurality of elongated tubular members stacked together for conducting a first fluid, and a wire wrapped around and bonded to said tubular members over a portion of the length of said tubular members to increase the surface area of said tubular member for heat transfer whereby said wire wrapped around one of said tubes contacts said wire wrapped around an adjacent of said tube whereby said wire controls the spacing therebetween.

19. A Stirling engine comprising:

a plurality of heat transfer stacks having a cooler, regenerator and heat exchanger stacked end-to-end along an axis;

a plurality of working cylinders with one cylinder positioned adjacent each of said heat transfer stacks, each cylinder being generally parallel to and spaced from said adjacent stack;

at least one of said heat exchangers including a plurality of tubes arranged in a circular array with an open central area, said tubes conducting a working cycle fluid of said Stirling engine, said tubes extending axially from said regenerator and terminating in a manifold axially spaced from said regenerator;

said heat exchanger tubes having a non-circular cross-section and oriented such that they present a larger surface area generally parallel to the direction of gas flow through said heat exchanger as compared with a tube having a circular cross-section of equal area, said tubes having a wire wrapped around them for increased heat transfer area;

a combustion chamber having a gas flow outlet communicating with one axial end of said heat exchanger into said central area;

said combustion chamber having a cylindrical wall open at one end forming a gas flow outlet communicating with said heat exchanger whereby combustion gases from said outlet flow through the spaces between said heat exchanger tubes, said cylindrical wall having a plurality of tangential slots which define air inlets for allowing air to enter the interior of said combustion chamber and means forming a fuel nozzle in each tangential slot so that air flowing through said slots draws fuel from said nozzles into the interior of said combustion chamber whereby said fuel and air combust in said combustion chamber and generate hot gases which apply heat to said heat exchanger;

means for restricting the flow of said gas between said heat exchanger tubes along a portion of the length of said tubes at the end of said tubes opposite said end communicating with said combustion chamber whereby the heating of said tubes is substantially isothermal along the length of said tubes;

each stack being connected to said adjacent working cylinder by a plurality of connecting ducts for conducting said working cycle fluid between said heat exchanger and said working cylinder whereby bending deflection of said ducts permits movement of each stack relative to the adjacent cylinder as said stacks and cylinders are exposed to thermal gradients and expansion.

* * * * *